US009868623B1

(12) United States Patent
Guy

(10) Patent No.: US 9,868,623 B1
(45) Date of Patent: Jan. 16, 2018

(54) LOAD POSITION DISPLAY INDICATOR FOR AN EXCAVATION SYSTEM

(71) Applicant: Caterpillar Inc., Peoria, IL (US)

(72) Inventor: Christopher James Guy, Wentworth-Nord (CA)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/405,674

(22) Filed: Jan. 13, 2017

(51) Int. Cl.
*B66F 9/00* (2006.01)
*B66F 9/075* (2006.01)
*B66F 9/12* (2006.01)

(52) U.S. Cl.
CPC ..... *B66F 9/0755* (2013.01); *B66F 9/12* (2013.01); *B66F 9/127* (2013.01)

(58) Field of Classification Search
CPC .. B66F 9/00; B66F 9/02; B66F 9/0755; B66F 9/07581; B66F 9/12; B66F 9/122; B66F 9/127; B60P 1/045; B60P 1/24; B60P 1/26; B60P 1/267; G01M 1/122; G01M 1/125
See application file for complete search history.

(56) References Cited

U.S. PATENT DOCUMENTS 4,839,835 A * 6/1989 Hagenbuch ..... G01G 19/08 177/136
4,852,674 A 8/1989 Gudat
4,981,186 A 1/1991 Shankle et al.
5,887,914 A * 3/1999 Hagenbuch ..... B60P 1/16 296/183.2
6,157,889 A 12/2000 Baker
8,966,962 B2 * 3/2015 Kamada ..... B60P 1/045 701/124
2004/0031628 A1 * 2/2004 Schiebel ..... B66F 17/003 177/146
2009/0174538 A1 * 7/2009 Shibata ..... B60K 6/48 340/438

FOREIGN PATENT DOCUMENTS

JP H2-6717 1/1990

* cited by examiner

*Primary Examiner* — Van Trieu
(74) *Attorney, Agent, or Firm* — Finnegan, Henderson, Farabow, Garret & Dunner, LLP

(57) ABSTRACT

A load position indicating system includes a portable, stand-alone computing device for use on the loader. The stand-alone computing device includes a display, a wireless communication interface configured for peer-to-peer direct communication with an electronic control unit (ECU) mounted onboard the hauler, and at least one controller configured to receive a signal indicative of a real time position of an actual center of gravity of a payload carried by the hauler, determine a real time position and orientation of the loader relative to the hauler, determine a target location for the center of gravity of the payload carried by the hauler, calculate a new loading position for a payload to be deposited by the loader onto the hauler based on a difference between the real time position of the actual center of gravity of the payload and the target location of the center of gravity, and display at least one of the new loading position for a payload, the target location for the center of gravity of the payload, and the real time position of the actual center of gravity of the payload on an image representative of the hauler as seen from a perspective of an operator on the loader.

20 Claims, 4 Drawing Sheets

LOAD POSITION DISPLAY INDICATOR FOR AN EXCAVATION SYSTEM

TECHNICAL FIELD

The present disclosure is directed to a load position display indicator and, more particularly, to a load position display indicator for an excavation system.

BACKGROUND

Mobile haul vehicles, such as mining trucks and articulated haul trucks (hereinafter referred to as "haulers"), have historically been used to transport minerals or other materials between different locations at a worksite and from a worksite to other locations. For example, the haulers can be loaded with ore at a first location by an excavation machine (e.g., a rope shovel, a hydraulic shovel, a front end loader, or other excavators—hereinafter referred to as "loaders"), and transport the ore to a processor at a second location at or away from the worksite. When a hauler such as a dump truck is loaded with ore or other materials at the worksite, uneven truck payload distribution causes uneven tire loading and excessive tire heating. This can reduce productivity as truck speeds are reduced as a result of the higher tire temperatures. Uneven truck payload distribution can also cause excessive wear on mechanical components of the truck.

Improper payload distribution also promotes vehicle wear. Strut, frame, and tire damage can occur if the payload is distributed unevenly. A payload monitor may accurately calculate total payload with an unsymmetrical distribution, but does not fully protect the vehicle frame and suspension from overloads. Merely determining the actual payload to prevent overloading is not sufficient to fully protect the vehicle, since uneven distribution causes overloads on portions of the vehicle. An operator of a loader such as a front end loader or other excavator needs real time indications of the position of the payload on a hauler during the loading process in order to achieve optimal load placement.

One attempt to address the above-identified issues is disclosed in U.S. Pat. No. 4,852,674 of Gudat that issued on Aug. 1, 1989 ("the '674 patent"). In particular, the '674 patent discloses an apparatus for displaying the distribution of the load, in a hauler such as an off-highway truck, to both the hauler operator and the loader operator. The information is conveyed to the operators using displays having varying color ranges generally indicative of the load in portions of the dump body of the hauler. Using this tool the hauler operator attains optimum positioning of the hauler prior to and during the loading cycle, while the loader operator directs loads to portions of the dump body of the hauler having lower displayed loads.

Although the apparatus of the '674 patent helps a loader operator to evenly distribute the payload on a hauler in real time, further improvements may be achieved by providing the loader operator with additional real time information during a loading process. Examples of useful additional information may include providing the loader operator with a visual indication of exactly where the center of gravity of the total payload of material on a hauler is located before and after each load is deposited on the hauler, and a visual indication of how the loader itself is positioned relative to the orientation of the hauler each time the hauler is moved into position relative to the loader for receipt of another load. A loader operator may have a limited field of view when approaching a hauler or when a hauler is maneuvered into position near the loader, and while the loader is carrying a load of material to be dumped onto the hauler. More than one hauler may also be moved into position on opposite sides of a loader during a loading operation, thereby requiring a loader operator to have a different perspective while loading each of the haulers. A relatively inexpensive and portable, stand-alone system that can be provided on demand to a loader operator if desired, and display all of the above information in real time, would facilitate optimal loading for increasing the longevity of tires and other operational components of the haulers.

The load position indicating system and load position display indicator according to the present disclosure are directed towards overcoming one or more of the problems set forth above and/or other problems of the prior art.

SUMMARY

One aspect of the present disclosure is directed to a load position indicating system. The load position indicating system includes a first location device associated with a loader, a second location device associated with a hauler, and a portable, stand-alone computing device for use on the loader. The stand-alone computing device includes a display, a wireless communication interface configured for peer-to-peer direct communication with an electronic control unit (ECU) mounted onboard the hauler, and at least one controller in communication with the first location device, the second location device, the ECU, the wireless communication interface, and the display. The at least one controller is configured to receive a first signal from at least one of the second location device and the ECU indicative of a location and orientation of the hauler, a second signal from the first location device indicative of a location and orientation of the loader, and a third signal indicative of a real time position of an actual center of gravity of a payload carried by the hauler. The at least one controller is further configured to determine a real time position and orientation of the loader relative to the hauler, determine a target location for the center of gravity of the payload carried by the hauler, calculate a new loading position for a payload to be deposited by the loader onto the hauler based on a difference between the real time position of the actual center of gravity of the payload and the target location of the center of gravity, and display at least one of the new loading position for a payload, the target location for the center of gravity of the payload, and the real time position of the actual center of gravity of the payload on an image representative of the hauler as seen from a perspective of an operator on the loader.

Another aspect of the present disclosure is directed to a method for indicating a real time position located on a hauler for placement of a payload from a loader. The method includes receiving at a portable, stand-alone computing device on the loader a geographical location and orientation of the loader from a first location device associated with the loader, receiving at the stand-alone computing device on the loader a geographical location and orientation of the hauler from at least one of a second location device associated with the hauler and an electronic control unit (ECU) mounted onboard the hauler, and receiving at the stand-alone computing device a signal indicative of a real time position of an actual center of gravity of a payload carried by the hauler. The method further includes determining, with a processor of the stand-alone computing device, a real time position and orientation of the loader relative to the hauler, determining a target location for the center of gravity of the payload carried by the hauler, calculating a new loading position for a payload to be deposited by the loader onto the hauler based on a difference between the real time position of the actual center of gravity of the payload and the target location of the center of gravity, and displaying on a display of the stand-alone computing device at least one of the new loading position for a payload, the target location for the center of gravity of the payload, and the real time position of the actual center of gravity of the payload on an image representative of the hauler as seen from a perspective of an operator on the loader.

Yet another aspect of the present disclosure is directed to a portable, stand-alone computing device for use on a loader to determine and indicate a loading position on a hauler for a payload to be deposited by the loader onto the hauler. The stand-alone computing device includes a display, a wireless communication interface configured for peer-to-peer direct communication with an electronic control unit (ECU) mounted onboard the hauler, and at least one controller in communication with a first location device associated with the loader, a second location device associated with the hauler, the ECU, the wireless communication interface, and the display. The at least one controller is configured to receive a first signal from at least one of the second location device and the ECU indicative of a location and orientation of the hauler, a second signal from the first location device indicative of a location and orientation of the loader, and a third signal indicative of a real time position of an actual center of gravity of a payload carried by the hauler. The at least one controller is also configured to determine a real time position and orientation of the loader relative to the hauler, determine a target location for the center of gravity of the payload carried by the hauler, calculate a new loading position for a payload to be deposited by the loader onto the hauler based on a difference between the real time position of the actual center of gravity of the payload and the target location of the center of gravity, and display at least one of the new loading position for a payload, the target location for the center of gravity of the payload, and the real time position of the actual center of gravity of the payload on an image representative of the hauler as seen from a perspective of an operator on the loader.

DETAILED DESCRIPTION

Figure 1:
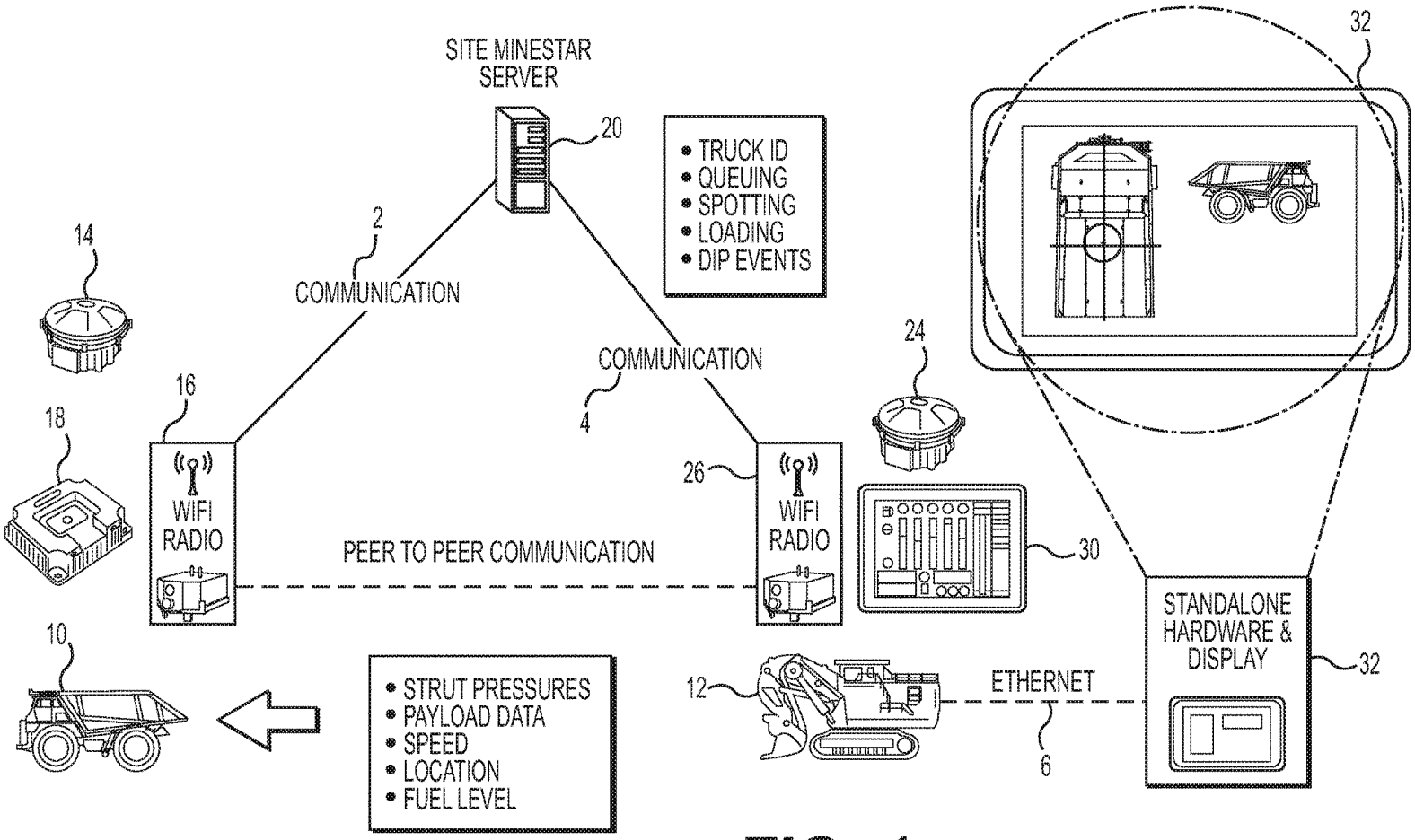
FIG. 1 is a schematic illustration of an exemplary disclosed load position indicating system.

FIG. 1 illustrates an exemplary load position indicating system that may include a portable stand-alone computing device 32 with hardware and a display. The portable stand-alone computing device 32 may be a laptop, smartphone, or other ruggedized computing device equipped with at least one processor and associated memory configured to receive, store, and/or process data. The computing device 32 may include various applications, operating systems, software, and memory that enable flexibility in the use of the computing device with a variety of different loaders and haulers. Data stored on the computing device 32 or retrieved by the computing device may be indicative of one or more of forces or pressures exerted on suspension struts on a haul vehicle (hauler) 10, the ground speed of the hauler 10, the geographic location and orientation of the hauler 10 and a loader (excavator) 12, the fuel level for the hauler 10, pitch and roll angles of the hauler 10, images of specific types and/or models of various haulers 10 that may be loaded by the loader 12, and physical dimensions and other operating characteristics of each of the specific types and/or models of haulers 10.

The portable stand-alone computing device 32 may be carried by an operator of the loader 12, and may include one or more processors and a wireless communication interface 26 configured to receive wireless signals from an electronic control unit (ECU) 18 and a wireless communication interface 16 located on the hauler 10. The loader 12 may also include an associated location device such as a geographic positioning system (GPS) 24 configured to provide coordinates indicative of the location and orientation of the loader in real time. The hauler 10 may also include an associated location device such as the GPS 14 configured to provide coordinates indicative of the location and orientation of the hauler in real time. An integral control panel 30 on the loader provides operating information and controls as is known in the art, and the portable stand-alone computing device 32 according to various embodiments of this disclosure may be separate from the loader's integral control panel 30 and other standard on-board instrumentation and controls. The stand-alone features of the portable, stand-alone computing device 32 provide an operator of the loader 12 with an inexpensive, flexible, plug and play system configured to receive data from the loader 12 and any of a variety of different haulers 10, as well as from a central command server 20 or other sources of relevant data, such as the Internet.

In various exemplary embodiments of the load position indicating system according to this disclosure, the hauler 10 and the loader 12 may communicate over wireless communication links 2 and 4, respectively, with the central command server 20. The central command server may be a server located at a command center for a particular job site, or one or more servers located remotely from the job site and in communication with the hauler 10 and the loader 12 via satellite, the Internet, cellular service, or other communication systems. The wireless communication interfaces 16 and 26 on the hauler and the loader, respectively, also enable peer-to-peer communication between the individual machines and between the stand-alone computing device 32 on the loader and the ECU 18, GPS 14, and other control devices on or associated with the hauler 10. The stand-alone computing device 32 may be communicatively coupled with the loader's integral control panel 30 or other control devices on the loader 12 through an ethernet communication link 6, or through other communication links including wireless local area networking such as WiFi®, Long-Term Evolution (LTE) high-speed wireless communication, or other wireless technologies such as BLUETOOTH®.

Figure 2:
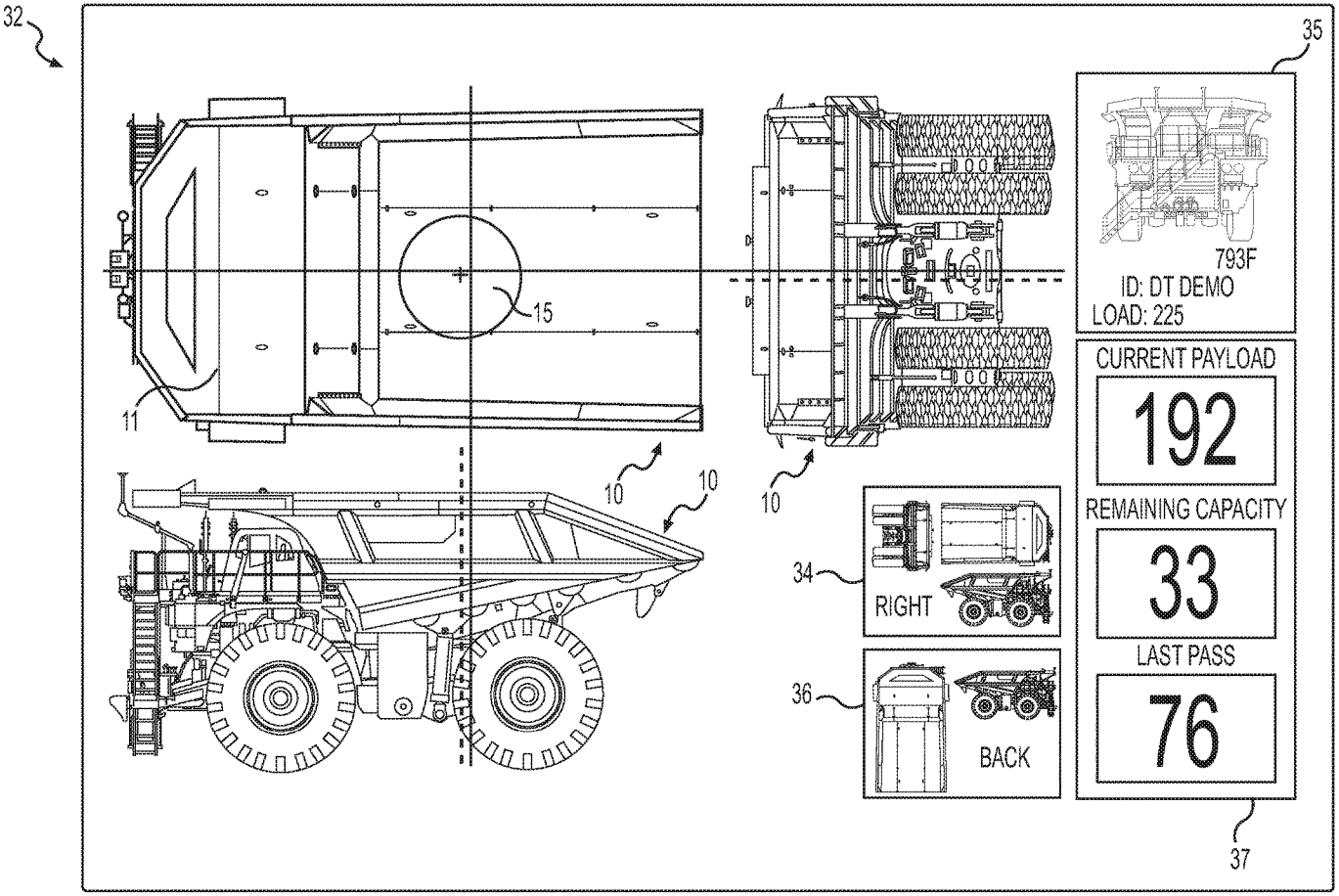
FIG. 2 is an exemplary disclosed standalone computing device screen showing a first potential real time display for a loader operator with the standalone hardware and display of the load position indicating system of FIG. 1.
Figure 3:
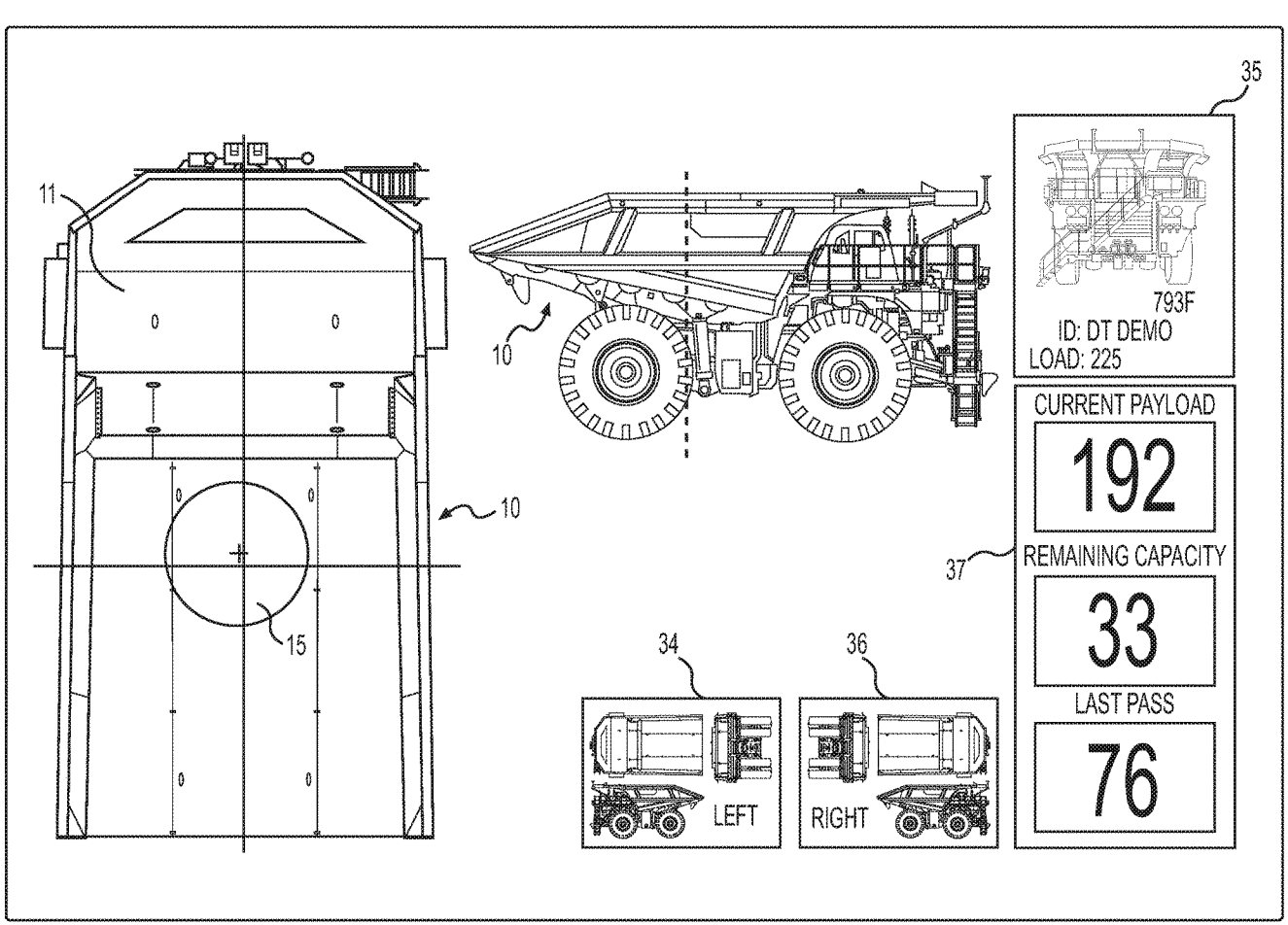
FIG. 3 is an exemplary disclosed standalone computing device screen showing a second potential real time display for a loader operator with the standalone hardware and display of the load position indicating system of FIG. 1.
Figure 4:
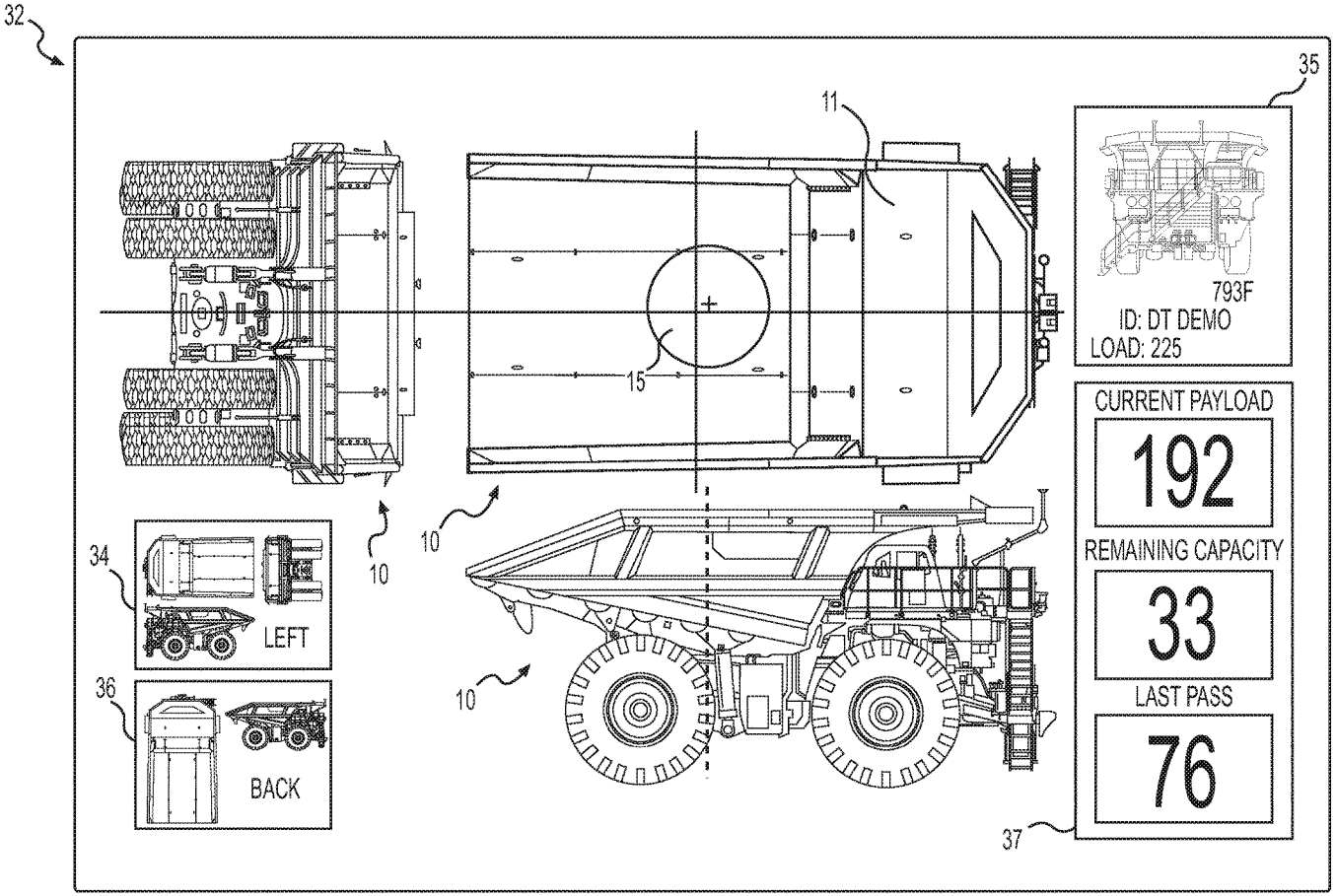
FIG. 4 is an exemplary disclosed standalone computing device screen showing a third potential real time display for a loader operator with the standalone hardware and display of the load position indicating system of FIG. 1.

As shown in FIG. 1, the load position indicating system according to various embodiments of this disclosure may include the first location device 24 associated with the loader 12, the second location device 14 associated with the hauler 10, and the portable, stand-alone computing device 32 for use on the loader 12. The hauler 10 includes the ECU 18 and the wireless communication interface 16, while the loader 12 includes the integral control panel 30, and the wireless communication interface 26. The portable, stand-alone computing device 32 may be provided as a plug-and-play system that is compatible with a number of different loaders and haulers, and that may be communicatively coupled with the integral control panel 30 on the loader 12, the ECU 18 on the hauler 10, the location devices 14, 24, and the central command server 20. The stand-alone computing device 32 includes a display, which may be divided into a plurality of display windows 34-37, as shown in FIGS. 2-4.

The stand-alone computing device 32 may include one or more controllers and/or processors that are configured to receive a first signal from at least one of the second location device 14 and the ECU 18 indicative of a location and orientation of the hauler 10. In addition to location and orientation information for the hauler 10, the ECU 18 may also provide additional real time information on various operational parameters of the hauler, such as pressures measured by sensors located at each of the suspension struts supporting the bed of the hauler, fuel level, tire pressures, the speed of the hauler, a calculated position of the actual center of gravity of any payload already being carried by the hauler, etc. A controller and/or one or more processors of the computing device 32 may also be configured to receive a second signal from the first location device 24 indicative of a location and orientation of the loader 12. The controller may be further configured to receive a third signal indicative of a real time position of an actual center of gravity of a payload carried by the hauler 10 and/or a target position for a desired location of the center of gravity of a payload carried by the hauler.

When a hauler is positioned near the loader 12 to receive a payload of material, the stand-alone computing device 32 on the loader 12 may be configured to automatically establish a line of communication with the ECU 18 and GPS 14 of the hauler 10 through the wireless communication interfaces 16, 26. In various exemplary implementations of this disclosure, an operator of the loader 12 may carry the computing device 32 as a portable, ruggedized laptop that has been programmed and loaded with data specific to the particular loader and/or haulers that will be involved in the loading operations. In other alternative implementations, the computing device may be supplied with the loader, or provided as a plug-and-play system that may be plugged into an existing control system for a partially or completely autonomously controlled loader. The stand-alone computing device 32 may be configured to receive a variety of data relevant to a loading operation, including suspension strut pressures for the particular hauler 10 that has pulled up to the loader, payload data for the hauler, the speed of the hauler, the exact location and orientation of the hauler relative to the loader, the fuel level for the hauler, and other information that may be relevant to the loading operation and specific to the particular loader and hauler involved in a loading operation.

A controller of the stand-alone computing device 32 may be configured to utilize the information on the exact location and orientation of the loader and the hauler to determine a real time position and orientation of the loader relative to the hauler. The controller may also determine the target location for the center of gravity of the payload carried by the hauler, or receive information on the target location from the ECU 18. The target location for the center of gravity of the payload carried by the hauler may be determined by the physical dimensions of the particular hauler being loaded, and the location of suspension struts and other components on the particular hauler or the particular model or type of hauler being loaded. The target location may be a location of the center of gravity of the payload that will result in the optimum positioning of the payload on the hauler for promoting even wear on the tires and other components of the hauler. The target location for the center of gravity of the payload carried by the hauler may also be based at least in part on characteristics of the particular hauler being loaded, and may change over time. These characteristics may include the age and amount of wear on various suspension components, the weather and other temperature and humidity conditions under which the hauler is operating at any particular time, the air pressure in the tires of the hauler, and other operating characteristics.

The controller of the stand-alone computing device 32 may be still further configured to calculate a new loading position for a payload to be deposited by the loader onto the hauler based on a difference between the real time position of the actual center of gravity of the payload and the target location of the center of gravity. The real time position of the actual center of gravity of the payload may be adjusted in real time as material is loaded onto the bed of the hauler by feedback signals communicated to the stand-alone computing device 32 from the ECU 18. The feedback signals may be indicative of pressures or loads sensed by one or more sensors located on suspension struts or other components of the hauler affected by the load on the bed of the hauler. The new loading position for a payload to be deposited by the loader onto the hauler may be displayed on a portion of the display for the computing device as a target symbol on an image representative of the hauler from the perspective of an operator on the loader. The display may show at least one of the new loading position for a payload, the target location for the center of gravity of the payload, and the real time position of the actual center of gravity of the payload.

As shown in FIGS. 2-4, the display of the stand-alone computing device 32 may be configured to show several different views of the hauler, including a top plan view, a side elevation view, and an end elevation view, with the views being displayed as a function of the actual real time position and orientation of the hauler as seen from the perspective of the loader. For example, in FIG. 2, the hauler 10 is positioned relative to the loader with the left side of the hauler facing the loader, and the cab 11 of the hauler facing to the left. The top plan view of the hauler in FIG. 2 shows a target symbol 15 positioned over the bed of the hauler relative to cross hairs that may approximately bisect the length and width of the hauler, with the intersection of the cross hairs representing a target location for the center of gravity of the payload in the hauler. One of ordinary skill in the art will recognize that the location of the cross hairs and the intersection of the cross hairs at the target location for the center of gravity of the payload may vary depending on factors such as the particular hauler being displayed, load carrying characteristics of the hauler, and even current conditions of suspension components on the hauler, such as the suspension struts, coil springs, sway bars, shock absorbers, and other suspension components for a particular hauler that is about to be loaded.

The projected location of the target symbol 15 is also shown as a dashed line in both a side elevation view from the left side of the hauler, and an end elevation view from the rear of the hauler. The target symbol 15 and/or intersection of the cross hairs may be representative of at least one of the new loading position for a payload, the target location for the center of gravity of the payload, and the real time position of the actual center of gravity of the payload. The target symbol 15 may be representative of the new loading position for a payload in order to provide an operator of the loader with a precise location for depositing a payload into the bed of the hauler in order to cause the center of gravity of the total payload already in the hauler to move toward a desired target location. In alternative implementations, the target symbol 15 may be representative of the real time position of the actual center of gravity of the payload so that the operator of the loader can adjust the dumping location accordingly to move the center of gravity toward a target location represented by the cross hairs shown over the bed of the hauler. In a partially or fully autonomous application, the stand-alone computing device 32 on the loader may include one or more processors that are configured to provide command signals to various controllers and/or operational components of one or both of the hauler and the loader. The command signals may result in automated maneuvering of one or both of the vehicles into the proper position to result in the payload of the loader being deposited at a new loading position coinciding with the location of the target symbol 15 on the bed of the hauler 10. The display may also include several additional display windows 34-37, which may include information on the particular model and/or type of hauler that is being loaded, additional condensed top plan views, side elevation views, and end elevation views of the hauler from different perspectives, and information on the current payload on the hauler, the remaining capacity of the hauler, and the amount of materials deposited onto the hauler in a last pass.

FIG. 3 illustrates the display on the stand-alone computing device 32 when the hauler 10 is positioned relative to the loader with the rear end of the hauler facing the loader. The display also shows a projection of the target symbol 15 positioned over the bed of the hauler relative to cross hairs that may illustrate a desired target location for the payload being carried by the hauler. The target symbol 15 and/or intersection of the cross hairs may be representative of at least one of the new loading position for a payload, the target location for the center of gravity of the payload, and the real time position of the actual center of gravity of the payload. The display shown in FIG. 3 also shows a projected location of the target symbol 15 in a side elevation view from the perspective of a loader located on the right side of the hauler, with the cab 11 of the hauler facing to the right.

FIG. 4 illustrates the display on the stand-alone computing device 32 when the hauler 10 is positioned relative to the loader with the right side of the hauler facing the loader and the cab 11 of the hauler facing to the right. The display also shows a projection of the target symbol 15 positioned over the bed of the hauler. The target symbol 15 and/or intersection of the cross hairs may be representative of at least one of the new loading position for a payload, the target location for the center of gravity of the payload, and the real time position of the actual center of gravity of the payload. In an alternative embodiment where the target symbol 15 is representative of the target location for the center of gravity of the payload, the target location may be displaced as shown from the cross hairs that bisect the length and width of the hauler as a result of a real time indication received at a processor of the stand-alone computing device 32 of a change in suspension characteristics of the particular hauler that is being loaded. The controller and one or more processors of the stand-alone computing device 32 may be programmed to automatically compensate for real time changes in operational characteristics of a particular hauler being loaded such that a payload is deposited in a position that deviates from an original target position for the center of gravity of the payload. The deviation may be desired, for example, as a result of a change in characteristics of a particular hauler such as the load carrying ability of one or more suspension struts on one side of the hauler. The display shown in FIG. 4 also shows a projected location of the target symbol 15 in a side elevation view from the right side of the hauler, and an end elevation view from the rear end of the hauler.

The load position indicating system according to various embodiments of this disclosure may include at least one controller and one or more processors included on the stand-alone computing device 32 and configured to receive wirelessly at least a first signal from the ECU 18 and additional information relevant to a loading operation from the central command server 20. The additional information received wirelessly from the central command server 20 may include at least one of an identification of a hauler to be loaded by the loader, queuing information regarding a loading priority for a plurality of haulers to be loaded by the loader, and a preferred GPS location on one or more sides of the loader for spotting a hauler to receive a payload from the loader. The at least one controller and processors may be further configured to display the new loading position for the payload on the image of the hauler 10 in the form of a bullseye or other target symbol 15 as seen from the perspective of an operator on the loader 12. In addition, the controller and processors may be configured to display cross hairs on the image of the hauler 10 that are representative of a target location for the payload to be carried by the hauler 10.

The load position indicating system according to various implementations of this disclosure is configured to facilitate adjustments to the approximate position of a bucket of a loader 12 for releasing each load so as to shift the real time location of the center of gravity toward a desired target location. In various implementations, an operator (either human or partially or fully autonomous) may be enabled to dump each successive load at a point on the side of the target location opposite to the current, real time position of the actual center of gravity. After each successive load is released, the system may be configured to calculate an updated position of the center of gravity for the operator's next selection of a point of release. By following this procedure as each bucketful is loaded on the bed of the hauler 10, the operator can utilize the feedback provided by the system to ensure an approximately optimal weight distribution of the material loaded on the hauler 10. The word approximate is used because the release of each bucket load would only be roughly optimal in spite of the feedback and because the subsequent distribution of the new material may be uncertain.

According to various exemplary embodiments of this disclosure, the position of the bucket of the loader 12 may also be displayed on the display of the stand-alone computing device 32 for the operator's viewing while positioning the next bucketful over the bed of the hauler 10. The display may include a representation of the relative position and orientation of the hauler 10 in relationship to the loader 12 so that an operator of the loader is provided with real time information that assists with accurate dumping of each payload onto the hauler. The loader 12 may also be equipped with a positioning system capable of tracking the current location of the bucket of the loader. The controller and processors included with the stand-alone computing device 32 may be configured to display the position of the bucket in the form of a moving image overlaid on the image of the hauler 10 that the operator can use to place the bucket in the optimal position for dumping material at the location of the target symbol 15. The system may also be configured to calculate and display the actual position where the next load needs to be dumped in order to shift the current center of gravity to coincide with the target position for the center of gravity. In some embodiments, this actual position is represented by the target symbol 15 overlaid on an image of the hauler. Thus, the operator does not need to estimate the position for dumping each successive load onto the hauler 10 using common sense and educated judgement, but rather can follow the indication provided by the load position indicating system via the display of the stand-alone computing device 32.

As would be understood by those skilled in the art, the calculation of the location for release of each successive load of material onto the hauler 10 requires a knowledge of the total weight currently already loaded in the hauler, and the weight of the next bucketful expected to be dumped. The former piece of data is readily available to the system by keeping track of the cumulative weights measured by sensors on suspension struts or other load carrying components of the hauler when the hauler is first identified on arrival near a loader 12 and linked to the load position indicating system according to various implementations of this disclosure. The latter can be approximated by the average weight of each bucketful. Thus, the load position indicating system could be programmed to initially place the target symbol 15 to coincide with the intersection of the cross hairs that represent a center of the bed of the hauler as an initial target point for release of the first bucketful. The system may then display the target symbol 15 at a calculated x,y position where each successive load should be dropped in order to shift the center of gravity of the payload on the hauler to an optimal target point. The operator may achieve this result by visually following the image on the screen of the stand-alone computing device 32 and moving the boom and bucket of the loader until the point at which the loader will dump each load substantially coincides with the target symbol 15. In a completely automated system, the positioning of the bucket of a loader could be achieved by a feedback-loop control module programmed to drive the bucket until an image of the bucket, corresponding to the actual position of the bucket, coincides with a setpoint represented by the calculated position of the target symbol 15.

The load position indicating features of the various implementations of this disclosure are enhanced by the ability of the stand-alone computing device 32 to calculate and display the relative positions of the loader 12 and the hauler 10 each time a new hauler pulls up to the loader for loading. The stand-alone computing device 32 also includes or is connected to the wireless communication interface 26 such that information can be exchanged with the loader 12, the hauler 10, and the central command center 20. The controller and one or more processors of the stand-alone computing device 32 are configured to enable the computations required to determine the relative positions of the loader 12 and the hauler 10, and the position on the bed of the hauler at which the loader will dump each successive load for optimal positioning of the center of gravity of the payload. The controller and processors may include one or more microprocessors coupled to a data storage medium and a logic circuit or other programmed component that performs a series of specifically identified operations to implement the various calculations and procedures of the various embodiments.

The wireless communication interfaces 16, 26 of the hauler 10 and the loader 12, respectively, may be configured to facilitate data communication between different components (e.g., peer-to-peer communication between a controller of the stand-alone computing device 32 located on the loader 12 and the ECU 18 onboard the hauler 10, and communication between one or more controllers on the ECU onboard the hauler 10 and the central command server 20). The wireless communication interfaces may include hardware and/or software that enable the sending and/or receiving of data messages through various communications links. The communications links 2, 4 may include satellite, cellular, infrared, radio, and any other type of wireless communications. The communications links 6 between the stand-alone computing device 32 and the integral control panel 30 or other control interfaces on the loader 12 may include electrical, optical, ethernet, or any other type of wired or wireless communications, if desired.

The display of the stand-alone computing device 32 may include one or more monitors, e.g., a liquid crystal display (LCD), a cathode ray tube (CRT), a personal digital assistant (PDA), a plasma display, a touch-screen, a portable handheld device, or any such display device known in the art and configured to actively and responsively show relative machine positions, recommendations, warnings, payloads, etc. to the operator of the associated machine. A controller of the stand-alone computing device 32 may embody a single or multiple microprocessors, field programmable gate arrays (FPGAs), digital signal processors (DSPs), etc., that include a means for controlling operations of the load position indicating system in response to operator input, built-in constraints, and sensed or communicated information. Numerous commercially available microprocessors can be configured to perform the functions of these components. Various known circuits may be associated with these components, including power supply circuitry, signal-conditioning circuitry, actuator driver circuitry (i.e., circuitry powering solenoids, motors, or piezo actuators), and communication circuitry.

INDUSTRIAL APPLICABILITY

The disclosed load position indicating system may be used at any worksite to help regulate the interactions between a loader and a hauler and facilitate loading of materials onto the hauler in an optimal position for prolonging the life of various components on the hauler such as the tires, the bed, and the suspension components. The optimal loading position on the hauler is determined such that the resulting center of gravity of the payload is located on the hauler to promote even wear on the tires and avoid unbalanced stresses on various mechanical components of the hauler.

A method employed by various implementations of the disclosed load position indicating system according to this disclosure facilitates the indication of a real time position located on a hauler for placement of a payload from a loader. In one exemplary implementation, the method may include receiving at the portable, stand-alone computing device 32 on the loader 12 a geographical location and orientation of the loader 12 from the first location device 24 associated with the loader 12. The method may also include receiving at the stand-alone computing device 32 on the loader 12 a geographical location and orientation of the hauler 10 from at least one of the second location device 14 associated with the hauler 10 and the electronic control unit (ECU) 18 mounted onboard the hauler 10. The method may still further include receiving at the stand-alone computing device 32 a signal indicative of a real time position of an actual center of gravity of a payload carried by the hauler 10.

A method employed by the various implementations of the disclosed load position indicating system may also include determining, with a processor of the stand-alone computing device 32, a real time position and orientation of the loader 12 relative to the hauler 10. The method may then include determining, with a processor of the stand-alone computing device, a target location for the center of gravity of the payload carried by the hauler, and calculating a new loading position for a payload to be deposited by the loader onto the hauler based on a difference between the real time position of the actual center of gravity of the payload and the target location of the center of gravity. An image representative of the hauler 10 may be displayed on the display of the stand-alone computing device 32 in an orientation corresponding to the actual orientation of the hauler relative to the loader, and including the target symbol 15 and cross hairs overlaid on the bed of the hauler to represent at least one of the new loading position for a payload, the target location for the center of gravity of the payload, and the real time position of the actual center of gravity of the payload as seen from a perspective of an operator on the loader.

The method employed by various exemplary implementations of this disclosure may further include receiving wirelessly at least a first signal from the ECU 18 and additional information relevant to a loading operation from the central command server 20. The information received from the central command server 20 may include at least one of an identification of a hauler 10 to be loaded by the loader 12, queuing information regarding a loading priority for a plurality of haulers to be loaded by the loader, and a preferred GPS location on one or more sides of the loader for spotting a hauler to receive a payload from the loader. The signal indicative of the real time position of the actual center of gravity of the payload carried by the hauler 10 is based on one or more signals indicative of a load being measured at one or more suspension struts supporting a bed of the hauler. The real time position and orientation of the hauler 10 is displayed on the display of the stand-alone computing device 32 as seen from the perspective of the operator on the loader 12. The new loading position for each successive new payload to be dumped by the loader 12 onto the hauler 10 is displayed on the display of the stand-alone computing device 32 as seen from the perspective of the operator on the loader 12. Hauler data may be received by a controller of the stand-alone computing device 32 from a memory onboard or offboard the loader, and the hauler data may include image data specific to a particular model and type of hauler. The image data is displayed on the display of the stand-alone computing device based on the determined real time position and orientation of the loader relative to the hauler. Each new loading position for an additional payload being loaded onto the hauler by the loader may be represented on the image of the hauler in the form of a bullseye or other target symbol 15 as seen from the perspective of an operator on the loader 12.

It will be apparent to those skilled in the art that various modifications and variations can be made to the load position indicating system of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A load position indicating system, comprising:
- a first location device associated with a loader;
- a second location device associated with a hauler;
- a portable, stand-alone computing device for use on the loader, the stand-alone computing device including:
  - a display;
  - a wireless communication interface configured for peer-to-peer direct communication with an electronic control unit (ECU) mounted onboard the hauler; and
  - at least one controller in communication with the first location device, the second location device, the ECU, the wireless communication interface, and the display, the at least one controller being configured to:
    - receive a first signal from at least one of the second location device and the ECU indicative of a location and orientation of the hauler;
    - receive a second signal from the first location device indicative of a location and orientation of the loader;
    - receive a third signal indicative of a real time position of an actual center of gravity of a payload carried by the hauler;
    - determine a real time position and orientation of the loader relative to the hauler;
    - determine a target location for the center of gravity of the payload carried by the hauler;
    - calculate a new loading position for a payload to be deposited by the loader onto the hauler based on a difference between the real time position of the actual center of gravity of the payload and the target location of the center of gravity; and
    - display at least one of the new loading position for a payload, the target location for the center of gravity of the payload, and the real time position of the actual center of gravity of the payload on an image representative of the hauler as seen in real time from a perspective of an operator on the loader.

2. The load position indicating system of claim 1, wherein the at least one controller is further configured to receive wirelessly at least the first signal from the ECU and additional information relevant to a loading operation from a central command server.

3. The load position indicating system of claim 2, wherein the at least one controller is configured to wirelessly receive information from the central command server, wherein the information includes at least one of an identification of a hauler to be loaded by the loader, queuing information regarding a loading priority for a plurality of haulers to be loaded by the loader, and a preferred GPS location on one or more sides of the loader for spotting a hauler to receive a payload from the loader.

4. The load position indicating system of claim 1, wherein the at least one controller is further configured to receive the third signal indicative of the real time position of the actual center of gravity of the payload carried by the hauler based on one or more signals indicative of a load being measured at one or more struts of the hauler.

5. The load position indicating system of claim 4, wherein the at least one controller is further configured to send one or more signals to the display indicative of the real time position and orientation of the hauler as seen from the perspective of the operator on the loader, along with the third signal.

6. The load position indicating system of claim 5, wherein the at least one controller is still further configured to send one or more signals to the display indicative of the new loading position for a payload.

7. The load position indicating system of claim 1, wherein the at least one controller is further configured to:

receive hauler data from a memory, the hauler data including image data for a hauler; and display the image data on the display in an orientation based on the determined real time position and orientation of the loader relative to the hauler.

8. The load position indicating system of claim 7, wherein the hauler data includes image data specific to the actual model and type of hauler positioned in real time for loading by the loader.

9. The load position indicating system of claim 8, wherein the at least one controller is further configured to display the new loading position for the payload on the image of the hauler in the form of a bullseye or other target symbol as seen from the perspective of an operator on the loader.

10. A method for indicating a real time position located on a hauler for placement of a payload from a loader, the method comprising:

receiving at a portable, stand-alone computing device on the loader a geographical location and orientation of the loader from a first location device associated with the loader;

receiving at the stand-alone computing device on the loader a geographical location and orientation of the hauler from at least one of a second location device associated with the hauler and an electronic control unit (ECU) mounted onboard the hauler;

receiving at the stand-alone computing device a signal indicative of a real time position of an actual center of gravity of a payload carried by the hauler;

determining, with a processor of the stand-alone computing device, a real time position and orientation of the loader relative to the hauler;

determining, with a processor of the stand-alone computing device, a target location of the center of gravity of the payload carried by the hauler;

calculating, with a processor of the stand-alone computing device, a new loading position for a payload to be deposited by the loader onto the hauler based on a difference between the real time position of the actual center of gravity of the payload carried by the hauler and the target location of the center of gravity; and displaying on a display of the stand-alone computing device at least one of the new loading position for a payload, the target location of the center of gravity of the payload, and the real time position of the actual center of gravity of the payload on an image representative of the hauler as seen from a perspective of an operator on the loader.

11. The method of claim 10, further including receiving wirelessly at least a first signal from the ECU and additional information relevant to a loading operation from a central command server.

12. The method of claim 11, further including wirelessly receiving information from the central command server, wherein the information includes at least one of an identification of a hauler to be loaded by the loader, queuing information regarding a loading priority for a plurality of haulers to be loaded by the loader, and a preferred GPS location on one or more sides of the loader for spotting a hauler to receive a payload from the loader.

13. The method of claim 10, wherein the signal indicative of the real time position of the actual center of gravity of the payload carried by the hauler is based on one or more signals indicative of a load being measured at one or more struts of the hauler.

14. The method of claim 13, wherein the real time position and orientation of the hauler is displayed on the display of the stand-alone computing device as seen from the perspective of the operator on the loader.

15. The method of claim 14, wherein the new loading position for a payload is displayed on the display of the stand-alone computing device as seen from the perspective of the operator on the loader.

16. The method of claim 10, further including:

receiving hauler data from a memory, the hauler data including image data for a hauler; and displaying the image data on the display of the stand-alone computing device in an orientation based on the determined real time position and orientation of the loader relative to the hauler.

17. The method of claim 16, wherein the hauler data includes image data specific to the actual model and type of hauler positioned in real time for loading by the loader.

18. The method of claim 17, further including displaying the new loading position for the payload on the image of the hauler in the form of a bullseye or other target symbol as seen from the perspective of an operator on the loader.

19. A portable, stand-alone computing device for use on a loader to determine and indicate a loading position on a hauler for a payload to be deposited by the loader onto the hauler, the stand-alone computing device including:

a display;

a wireless communication interface configured for peer-to-peer direct communication with an electronic control unit (ECU) mounted onboard the hauler; and at least one controller in communication with a first location device associated with the loader, a second location device associated with the hauler, the ECU, the wireless communication interface, and the display, the at least one controller being configured to:

receive a first signal from at least one of the second location device and the ECU indicative of a location and orientation of the hauler;

receive a second signal from the first location device indicative of a location and orientation of the loader;

receive a third signal indicative of a real time position of an actual center of gravity of a payload carried by the hauler;

determine a real time position and orientation of the loader relative to the hauler;

determine a target location for the center of gravity of the payload carried by the hauler;

calculate a new loading position for a payload to be deposited by the loader onto the hauler based on a difference between the real time position of the actual center of gravity of the payload and the target location of the center of gravity; and display at least one of the new loading position for a payload, the target location for the center of gravity of the payload, and the real time position of the actual center of gravity of the payload on an image representative of the hauler as seen from a perspective of an operator on the loader.

20. The portable, stand-alone computing device of claim 19, wherein the at least one controller is further configured to:

receive the third signal indicative of the real time position of the actual center of gravity of the payload carried by the hauler based on one or more signals indicative of a load being measured at one or more struts supporting a bed of the hauler, receive hauler data from a memory, the hauler data including image data for a hauler; and display the image data on the display in an orientation based on the determined real time position and orientation of the loader relative to the hauler and including a target symbol on the displayed image at the new loading position for a payload.

* * * * *